US007073966B2

(12) United States Patent
Murakoshi

(10) Patent No.: US 7,073,966 B2
(45) Date of Patent: Jul. 11, 2006

(54) SOLID PASTE DISPENSER AND SLIDER FOR USE THEREWITH

(75) Inventor: Yasuo Murakoshi, Saitama (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

(21) Appl. No.: 10/606,181

(22) Filed: Jun. 26, 2003

(65) Prior Publication Data

US 2004/0056051 A1 Mar. 25, 2004

(30) Foreign Application Priority Data

Jun. 26, 2002 (JP) ..... 2002-185461

(51) Int. Cl.
*A45D 40/06* (2006.01)

(52) U.S. Cl. ..... 401/87; 401/68; 401/175

(58) Field of Classification Search ..... 401/55, 401/65, 68, 75, 82, 86–88, 172, 175; 222/390
See application file for complete search history.

(56) References Cited

U.S. PATENT DOCUMENTS 2,818,167 A * 12/1957 McKinley ..... 401/75
3,612,705 A * 10/1971 Duval ..... 401/75

FOREIGN PATENT DOCUMENTS

| | | | |
|---|---|---|---|
| DE | 31 18 893 | A | 11/1982 |
| GB | 1 427 931 | A | 3/1976 |
| JP | 2000335193 | A | 12/2000 |
| JP | 2003-63197 | A | 3/2003 |

* cited by examiner

*Primary Examiner*—Justine R. Yu
*Assistant Examiner*—Huyen Le
(74) *Attorney, Agent, or Firm*—Sughrue Mion, PLLC

(57) ABSTRACT

A solid paste dispenser and a slider for use therewith that enable the effective use of solid paste for sticking purposes by reducing any paste remaining unused, while not damaging a paper or like surface. The solid paste dispenser has a slider holding a stick of solid paste thereon, and the slider can be raised and lowered in a cylindrical body by its threaded engagement with a screw rod forming an integral part of a tail plug attached to one end of the cylindrical body so that the solid paste may have a distal end free to protrude from the cylindrical body and retract thereinto. The slider has a plate portion and a cylindrical portion projecting from the center of the plate portion on its side holding the solid paste thereon, and the screw rod extends through the cylindrical portion in a threadedly engaged relation therewith. The cylindrical portion has a radially outwardly extending engaging protrusion that is deformable at least at its outer edge in the direction of the longitudinal axis of the cylindrical portion.

6 Claims, 6 Drawing Sheets

SOLID PASTE DISPENSER AND SLIDER FOR USE THEREWITH

This is an Application claiming Convention priority from Japanese Patent Application No. 2002-185461, which was filed on Jun. 26, 2002 and the disclosure of which is incorporated into this application by reference.

FIELD AND BACKGROUND OF THE INVENTION

This invention relates to a solid paste dispenser and to a slider for holding a stick of solid paste for use with such solid paste dispenser.

Dispensers for feeding solid paste are described in, for example, Japanese Patent Application Laid-Open No. 59080/1999, Japanese Patent Publication No. 5502/1996 and Japanese Utility Model Registration No. 2,534,943.

They are such that a tail plug 02 fitted at one end of a cylindrical body 01 is rotatable for rotating a screw rod 03 forming an integral part of the tail plug 02 in the cylindrical body 01 and thereby raise and lower a slider 05 in the cylindrical body 01 by virtue of its threaded engagement with the screw rod 03 and its guidance by guide ridges 04 formed on the inner peripheral surface of the cylindrical body 01 along its longitudinal axis, the slider 05 holding a solid paste 06 at its rear end so that the solid paste 06 may have its front end free to protrude from the cylindrical body 01 and retract thereinto, as shown by a longitudinal sectional view in FIG. 8.

The slider 05 has a cylindrical shape with a bottom having a through hole in which the screw rod 03 is threadedly engaged.

The slider 05 as described above has, however, the following problems:

a) As the solid paste 06 in the form of a stick is simply fitted at one end in the bottomed cylindrical slider 05, the solid paste 06 is likely to come off the slider 05 if, for example, its distal end sticks to a surface to be coated, and is thereby dragged during its use.

b) The solid paste 06 is usually fitted in the bottomed cylindrical slider 05 along its rear end portion occupying about 15% of its overall length, and the solid paste portion fitted therein cannot be used effectively, but is wasted.

In order to solve the above problems, I, the inventor of this invention has previously proposed a new slider in Japanese Patent Application No. 149058/1999 (Laid-Open No. 2000-33519).

The slider according to the prior application as mentioned above is a slider 07 having a plate member 07*a* having a cylindrical central portion 07*b* through which a screw rod 03 will extend, and an engaging protrusion or protrusions 07*c* projecting outwardly from its periphery as its integral parts, as a form of its embodiment is shown by a perspective view in FIG. 9 and by the longitudinal sectional view taken along the line X—X of FIG. 9 in FIG. 10.

The use of the slider 07 makes it possible to prevent the coming off of solid paste as encountered with the traditional bottomed cylindrical slider 05.

When liquid paste is solidified into a stick of solid paste and held by the slider 07, it is solidified between the plate member 07*a* of the slider 07 and an engaging protrusion 07*c* and between the engaging protrusions 07*c*, so that the stick of solid paste may be engaged by the outwardly projecting engaging protrusions 07*c* and not come off the slider 07, even if a force tending to cause the solid paste to come off the slider 07 may act upon it longitudinally.

Moreover, the slider 07 according to the prior application does not have any cylindrical portion surrounding it as in the known slider 05, but the solid paste is exposed in its end portion surrounding the slider 07, so that the end portion of the solid paste can be used effectively for sticking purposes until the outer edges of the engaging protrusions 07*c* are exposed from the solid paste.

FIG. 11 is a longitudinal sectional view showing a solid paste dispenser 08 including the slider 07 shown in FIG. 9, and used with solid paste 09.

Even if the solid paste 09 may remain only in the vicinity of the slider 07 as a result of use, the outer peripheral portion 09*a* of the solid paste 09 pressed against a paper or like surface 010 can be used effectively for sticking purposes.

The slider 07 has, however, the following problems:

(1) The solid paste 09 remaining inwardly of the outer edges of the engaging protrusions 07*c* of the slider 07 is of no use for sticking purposes, since the outer edges of the engaging protrusions 07*c* abut on the paper or like surface 010.

(2) It is likely that the outer edges of the engaging protrusions 07*c* may be rubbed against the paper or like surface 010 and damage it.

OBJECTS OF THE INVENTION

It is an object of this invention to provide an improved solid paste dispenser and in particular a slider thereof for holding a stick of solid paste thereon. Another object of this invention is to provide a slider by which a solid paste portion remaining unused may be reduced as far as possible for its effective use for sticking purposes, while it does not damage any paper or like surface.

SUMMARY OF THE INVENTION

These and other objects pursuant to one aspect of the invention are attained by means of:

a slider of a solid paste dispenser for holding a stick of solid paste, said slider having a plate portion and a cylindrical portion projecting from the center of the plate portion on one of the opposite sides thereof, and an engaging protrusion radially outwardly extending from the cylindrical portion and being deformable at least at an outer edge portion thereof in a direction essentially corresponding to that of the longitudinal axis of the cylindrical portion.

According to an embodiment of the invention the engaging protrusion may be in the form of a circular or polygonal plate attached to the free end of the cylindrical portion coaxially therewith.

According to another embodiment of the invention the engaging protrusion has easily breakable lines that make it deformable in the direction of the longitudinal axis of the cylindrical portion.

According to another embodiment of the invention the easily breakable lines are formed by perforations.

According to another embodiment of the invention the engaging protrusion is formed by a porous plate that makes it deformable in the direction of the longitudinal axis of the cylindrical portion.

Pursuant to another aspect of the invention there is provided:

a slider of a solid paste dispenser for holding a stick of solid paste, said slider having a plate portion and a first cylindrical portion projecting from the center of the plate portion on one of the opposite sides thereof, and a second cylindrical portion projecting from said plate portion on the other side thereof coaxially with said first cylindrical portion, said second cylindrical portion having a diameter larger that that of the first cylindrical portion and being deformable under an axial force exerted thereon in a direction essentially corresponding to that of the longitudinal axis of the first and second cylindrical portions, said second cylindrical portion further having an engaging protrusion radially projecting from the second cylindrical portion at a distal end thereof.

According to an embodiment of the invention the engaging protrusion is in the form of a circular or polygonal plate attached to the distal end of the porous cylindrical portion coaxially therewith.

According to another embodiment of the invention the porous cylindrical portion has an outwardly bulged or curved middle portion between the top and bottom of its wall.

According to another embodiment of the invention the porous cylindrical portion has a multiplicity of inclined holes formed in its wall longitudinally thereof, but inclined in a specific direction to enable the engaging protrusion to rotate to some extent in a specific direction upon receiving a longitudinal load.

This invention exhibits the following advantages: The feature mentioned in paragraph [15] enables even the solid paste in the vicinity of the engaging protrusion of the slider to be used effectively for sticking purposes, since the engaging protrusion is deformed in the direction of the longitudinal axis of the cylindrical portion with the consumption of the solid paste in its outer peripheral portion pressed against a paper or like surface after the solid paste has been used until it remains only in the vicinity of the slider. Moreover, the deformation of the engaging protrusion relieves the paper or like surface from being damaged during use.

The feature mentioned in paragraph [16] enables the solid paste to be held by the slider reliably with a uniform force.

The feature mentioned in paragraph [17] enables even the solid paste in the vicinity of the engaging protrusion of the slider to be used effectively for sticking purposes, since the engaging protrusion is easily bent or broken along its easily breakable lines to have its outer edge deformed longitudinally of the cylindrical portion toward its rear end to thereby have the solid paste exposed between the engaging protrusion and the plate portion, with the consumption of the solid paste in its outer peripheral portion pressed against a paper or like surface after the solid paste has been used until it remains only in the vicinity of the slider.

The feature mentioned in paragraph [18] facilitates the formation of the easily breakable lines and exhibits similar advantages to those of the invention according to paragraph [17].

The feature mentioned in paragraph [19] facilitates the formation of the deformable engaging protrusion.

The feature mentioned in paragraph [20] enables the engaging protrusion to be easily inclined to a paper surface even if the engaging protrusion itself may be difficult to deform, and thereby exhibits the advantages of the invention according to paragraph [15].

The feature mentioned in paragraph [21] exhibits similar advantages to those of the invention according to paragraph [16].

The feature mentioned in paragraph [22] enables the solid paste to be used still more effectively for sticking purposes, since the porous cylindrical portion is outwardly bulged or curved to a still more extent in its middle wall portion upon application to a paper or like surface for use, so that its wall forces the solid paste between the engaging protrusion and the plate portion outwardly.

The feature mentioned in paragraph [23] facilitates the feeding of the solid paste to a paper or like surface, since the engaging protrusion is rotated to some extent upon application to the paper or like surface for use.

BRIEF DESCRIPTION OF THE DRAWINGS

The invention will be explained in more detail hereinafter with reference to the drawings and embodiments thereof. In the drawings.

DESCRIPTION OF THE PREFERRED EMBODIMENTS

Figure 1:
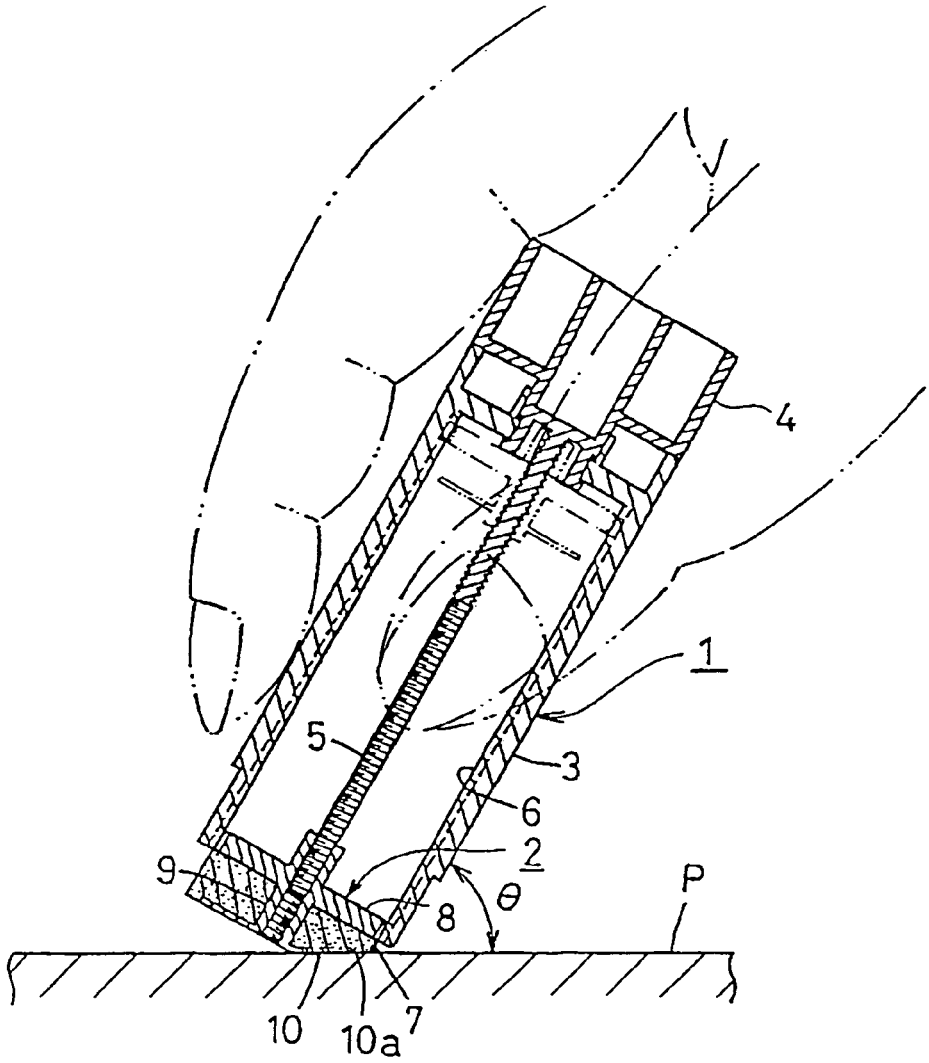
FIG. 1 is a longitudinal sectional view showing in use a solid paste dispenser embodying this invention.
Figure 2:
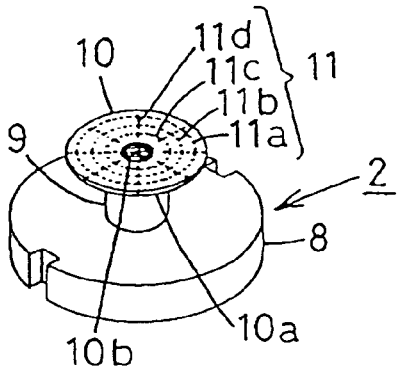
FIG. 2 is a perspective view of the slider of the solid paste dispenser shown in FIG. 1, as viewed from its bottom.

FIG. 1 is a longitudinal sectional view showing in use a solid paste dispenser 1 embodying this invention, and FIG. 2 is a perspective view of the slider 2 of the solid paste dispenser 1 shown in FIG. 1, as viewed from its bottom.

The solid paste dispenser 1 according to this invention has a slider 2 which can be raised and lowered in a cylindrical body 3 by virtue of its threaded engagement with a screw rod 5 and its guidance by guide ridges 6 formed on the inner peripheral surface of the cylindrical body 3 along its longitudinal axis if a tail plug 4 fitted at one end of the cylindrical body 3 is rotated to rotate the screw rod 5 forming an integral part of the tail plug 4 in the cylindrical body 3, the slider 2 holding a stick of solid paste 7 so that the solid paste 7 may have a distal end free to protrude from the cylindrical body 3 and retract thereinto, as is the case with what is traditionally known.

The solid paste dispenser according to this invention is characterized by the slider 2 incorporated therein.

The slider 2 according to a typical embodiment of this invention has a plate portion 8 and a cylindrical portion 9 projecting from the center of the plate portion on its bottom or its side holding the solid paste 7 thereon, the screw rod 5 extending through the cylindrical portion 9 in a threadedly engaged relation therewith, the cylindrical portion 9 having a radially outwardly extending engaging protrusion 10 that is deformable at least at its outer edge 10*a* in the direction of the longitudinal axis of the cylindrical portion 9, as shown in FIG. 2.

The engaging protrusion 10 is formed by a circular engaging protrusion 10 provided at the lower end of the cylindrical portion 9 coaxially with it and having a central opening 10*b* (hereinafter referred to also as "engaging disk"). The engaging disk may be replaced by e.g. a polygonal engaging protrusion.

The engaging disk 10 has easily breakable lines 11 that make its outer edge 10*a* easily deformable in the direction of the longitudinal axis of the cylindrical portion 9. More specifically, the engaging disk 10 having a small thickness has three coaxial rings 11*a*, 11*b* and 11*c* of perforations and a plurality of radial lines 11*d* of perforations.

The slider 2 can be loaded with solid paste 7 by placing the slider 2 in the bottom of a separately prepared paste loading cylinder not shown, pouring liquid paste through its top, cooling it to solidify it and removing solid paste from the paste loading cylinder, whereby the slider 2 is loaded with solid paste 7 having a front end engaged by the engaging disk 10.

FIG. 1 shows the mode of using the solid paste dispenser 1 including the slider 2 loaded with solid paste 7, and even the solid paste 7 between the engaging disk 10 of the slider 2 and its plate portion 8 can be used as effectively as possible for sticking purposes, since the engaging disk 10 is easily bent or broken along its perforations 11*a* to lid to have its outer edge 10*a* deformed longitudinally of the cylindrical portion 9 toward its rear end, as shown, with the consumption of the solid paste 7 in its outer peripheral portion pressed against a paper or like surface P after the solid paste 7 has been used until it remains only in the vicinity of the slider 2.

The way in which the engaging disk 10 is broken along the perforations 11*a* to 11*d* will now be described more specifically. Referring to FIG. 1, if the solid paste dispenser 1 has a small angle θ of inclination to the paper surface P, the engaging disk 10 is bent along the perforations 11*a* to 11*d* and if the angle θ of inclination increases, it is broken along the perforations 11*a* to 11*d* resulting usually in the progressive separation of its portions beginning with its portion close to its outer edge 10*a*. More specifically, its portions between its perforations 11*a* to 11*d* and its outer edge 10*a* are separated progressively by breaking along the rings of perforations in the order beginning with the one of the largest diameter. As a result, even the solid paste 7 between the engaging disk 10 arid the plate portion 8 is exposed as far as possible for its effective use for sticking purposes.

Figure 3:
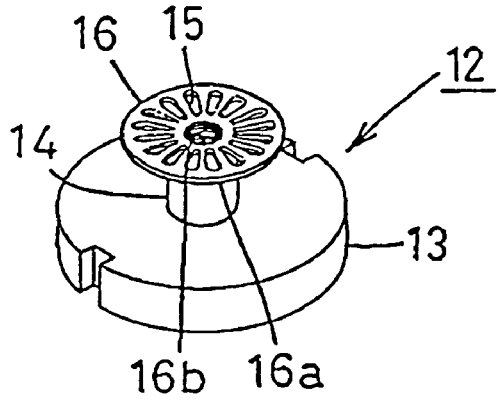
FIG. 3 is a view similar to FIG. 2, but showing another form of a slider of the solid paste dispenser according to this invention.

FIG. 3 is a view similar to FIG. 2, but shows another form of slider 12 for a solid paste dispenser embodying this invention.

The slider 12 is formed by providing the end of a cylindrical portion 14 upstanding from the center of a plate portion 13 with an engaging disk 16 having radially formed slots 15 shaped like water drops and a central opening 16*b* instead of the engaging disk 10 having the perforations 11*a* to 11*d* in the slider 2 shown in FIG. 2.

When a solid paste dispenser including the slider 12 shown in FIG. 3 instead of the slider 2 for the solid paste dispenser 1 shown in FIG. 1 is used by pressing against a paper surface P at an angle thereto, the radially formed slots 15 of the engaging disk 16 shaped like water drops enable it to be easily deformed at its outer edge 16*a* longitudinally of the cylindrical portion 14 toward its rear end, so that even the solid paste between the engaging disk 16 and the plate portion 13 may be used effectively for sticking purposes, as is the case with the embodiment described before.

Moreover, the slots 15 of the engaging disk 16 make it possible to use solid paste still more effectively, since solid paste is easily fed from between the engaging disk 16 and the plate portion 13 onto the paper surface P through the slots 15 with the deformation of the engaging disk 16 at its outer edge 16*a*.

Figure 4:
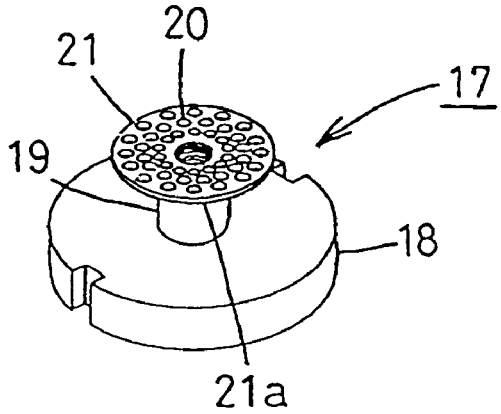
FIG. 4 is a view similar to FIG. 2, but showing still another form of a slider.

FIG. 4 shows a slider 17 formed by providing the end of a cylindrical portion 19 upstanding from the center of a plate portion 18 with an engaging disk 21 having a multiplicity of circular holes 20 instead of the engaging disk 16 having the slots 15 as shown in FIG. 3.

The slider 17 is as effective as the slider 12 shown in FIG. 3.

It is generally sufficient to form a multiplicity of adequately shaped holes in the engaging disk 16 or 21 to enable its outer edge 16*a* or 21*a* to be deformed longitudinally of the cylindrical portion 14 or 19 toward its rear end when the solid paste dispenser is used by pressing against the paper surface P at an angle thereto.

Figure 5:
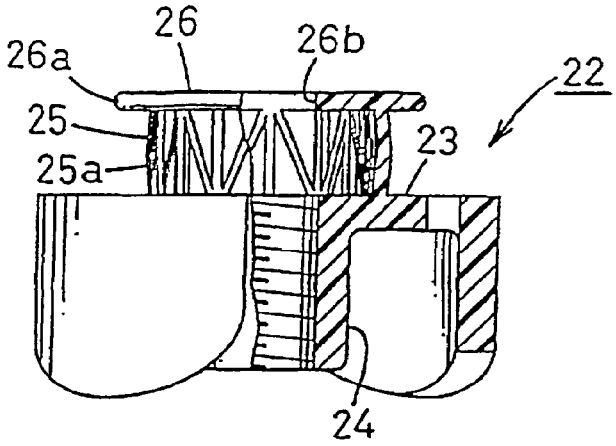
FIG. 5 is a view similar to FIG. 2, but showing a still different form of a slider.

FIG. 5 is a partly sectional front elevational view showing a slider 22 according to still another embodiment.

The slider 22 has a plate portion 23 and a cylindrical portion 24 projecting from the center of the plate portion 23 on its side opposite its side holding solid paste thereon, the screw rod 5 (see FIG. 1) extending through the cylindrical portion 24 in a threadedly engaged relation therewith, while the slider also has a porous cylindrical portion 25 formed on its side holding the solid paste thereon coaxially with the cylindrical portion 24, and having a diameter larger than that of the cylindrical portion 24, the porous cylindrical portion 25 being compressively deformable by a longitudinally directed pressure, and having an engaging disk (protrusion) 26 formed at its distal end, and having a central opening 26*b*.

The porous cylindrical portion 25 is somewhat bulged or curved outwardly in its middle portion between the top and bottom of its wall.

Figure 6:
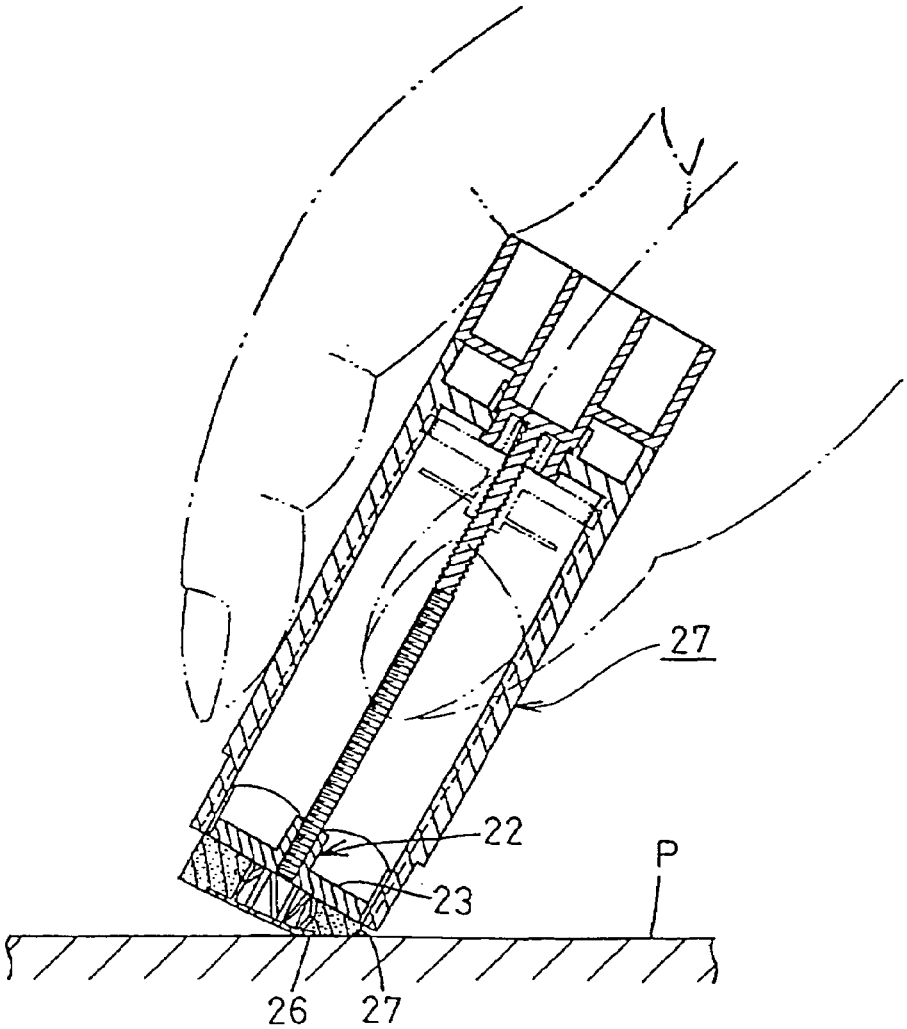
FIG. 6 is a view similar to FIG. 1, but showing in use a solid paste dispenser including the slider shown in FIG. 5.

FIG. 6 is a view similar to FIG. 1, but showing the mode of using a solid paste dispenser 27 having the slider 22 shown in FIG. 5.

When the solid paste dispenser 27 is used by pressing against a paper surface P at an angle thereto, the pressure applied thereto causes the outwardly curved middle wall portion 25*a* of the porous cylindrical portion 25 to be curved and protrude outwardly to a still more extent to thereby cause the engaging disk 26 to incline along the paper surface P and have its outer edge 26*a* deformed to some extent, while the solid paste 27 between the engaging disk 26 and the plate portion 23 is forced out by the porous wall of the porous cylindrical portion 25. Thus, the solid paste 27 can be used as effectively as possible for sticking purposes.

Figure 7:
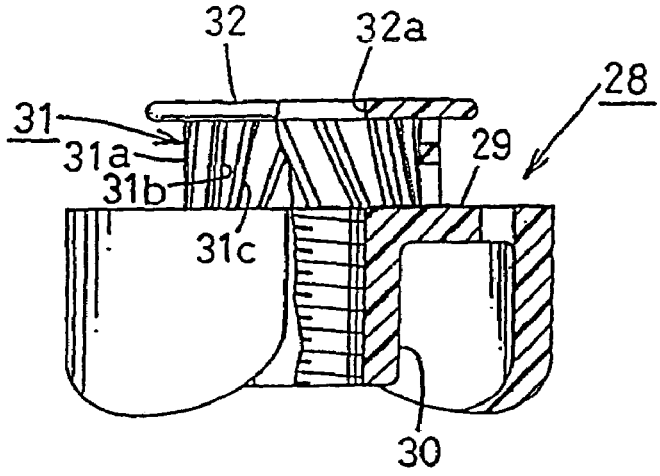
FIG. 7 is a view similar to FIG. 2, but showing a still different form of a slider of a solid paste dispenser according to this invention.
Figure 8:
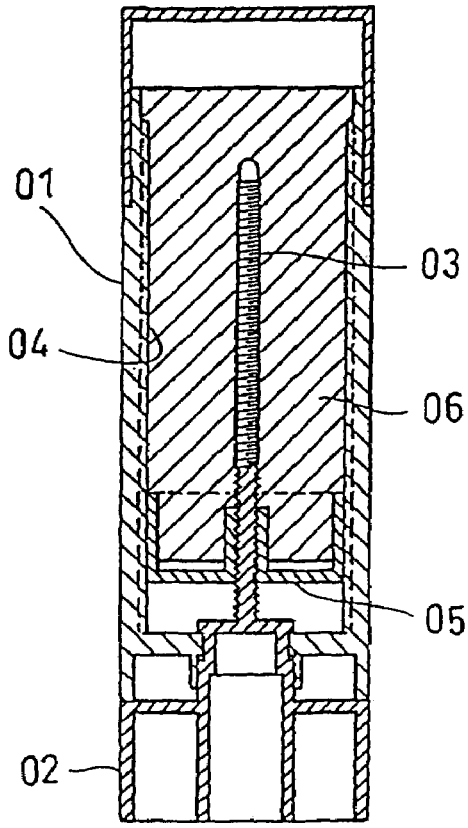
Fig. 8 Prior Art
FIG. 8 is a longitudinal sectional view of a traditionally known solid paste dispenser.
Figure 9:
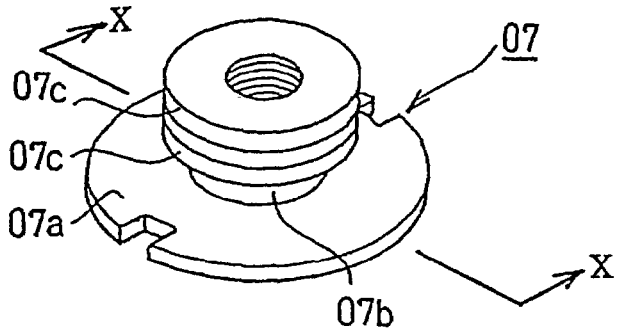
Fig. 9 Prior Art
FIG. 9 is a perspective view of the slider proposed in the prior application of the present applicant.
Figure 10:
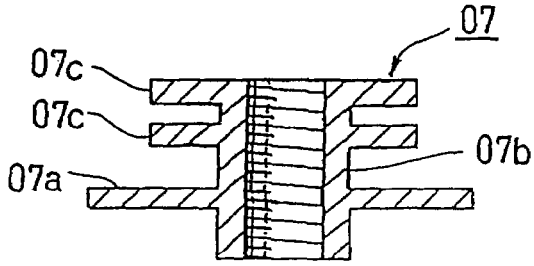
Fig. 10 Prior Art
FIG. 10 is a longitudinal sectional view of the slider shown in FIG. 9.
Figure 11:
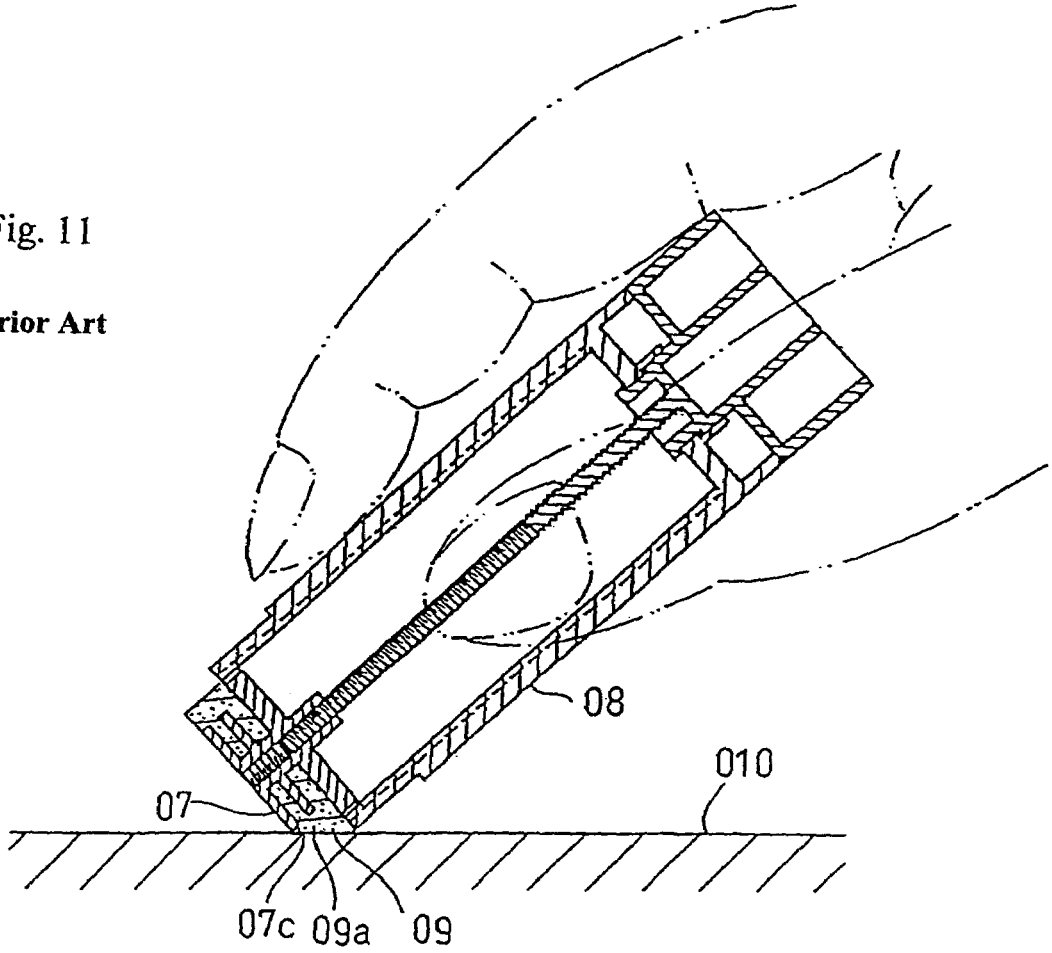
Fig. 11 Prior Art
FIG. 11 is a longitudinal sectional view showing in use a solid paste dispenser including the slider shown in FIG. 9, and supplied with solid paste.

FIG. 7 is a view similar to FIG. 5, but showing a slider 28 according to still another embodiment.

The slider 28 has a plate portion 29 and a first cylindrical portion 30 projecting from the center of the plate portion on its side opposite its side holding solid paste thereon, a screw rod 5 extending through the cylindrical portion in a threadedly engaged relation therewith, while the slider 28 also has a second porous cylindrical portion 31 formed on its side holding the solid paste thereon coaxially with the cylindrical portion 30, and having a diameter larger than that of the cylindrical portion 30, the porous cylindrical portion 31 having an engaging disk 32 formed at its distal end and having a central opening 32*a*, as is equal to what is shown in FIG. 5.

The slider 28 is characterized by the form of holes 31*b* in the wall 31*a* of the porous cylindrical portion 31. More specifically, longitudinally elongated inclined holes 31*b* are formed in a specific direction throughout the wall 31*a* and a multiplicity of inclined elongated needle-like members 31*c* formed between the adjoining inclined holes 31*b* support the engaging disk 32 on the plate portion 29. Therefore, the engaging disk 32 approaches the plate portion 29, while rotating to some extent about its own center, if pressed against a paper or like surface for use.

The rotation of the engaging disk 32 facilitates the feeding of solid paste from between the engaging disk 32 and the plate portion 29 onto the paper surface and thereby the effective use of the solid paste.

The above description of embodiments of the invention has been given by way of example. From the disclosure given, those skilled in the art will not only understand the present invention and the attendant advantages, but will also find apparent various changes and modifications to the structures disclosed. It is sought, therefore, to cover all such changes and modifications as within the spirit and scope of the invention, as defined by the appended claims, and equivalents thereof.

What is claimed is:

1. A slider of a solid paste dispenser for holding a stick of solid paste, said slider including a plate portion, a cylindrical portion projecting from the center of the plate portion on one of the opposite sides thereof, and an engaging protrusion radially outwardly extending from the cylindrical portion and being deformable at least at an outer edge portion thereof in a direction essentially corresponding to that of the longitudinal axis of the cylindrical portion, wherein the engaging protrusion has easily breakable lines for rendering the engaging protrusion deformable.

2. The slider according to claim 1, wherein the engaging protrusion is in the form of a circular or polygonal plate attached to a free end of the cylindrical portion coaxially therewith.

3. The slider according to claim 1, wherein the easily breakable lines are formed by perforations.

4. The slider according to claim 1, wherein the engaging protrusion is formed by a porous plate for rendering the engaging protrusion deformable.

5. The slider according to claim 1, wherein said cylindrical portion including a threaded through bore for threadably engaging with a screw rod.

6. A solid paste dispenser including a slider which can be raised and lowered in a cylindrical body by virtue of its threaded engagement with a screw rod and its guidance by guide ridges formed on the inner peripheral surface of the cylindrical body along its longitudinal axis if a tail plug fitted at one end of the cylindrical body is rotated to rotate the screw rod forming an integral part of the tail plug in the cylindrical body, said slider holding a stick of solid paste so that the solid paste may have a distal end free to protrude from the cylindrical body and retract thereinto, said slider having a plate portion, a cylindrical portion projecting from the center of the plate portion on a side thereof holding the solid paste thereon, the screw rod extending through the cylindrical portion in a threadedly engaged relation therewith, and an engaging protrusion radially outwardly extending from said cylindrical portion and being deformable at least at an outer edge portion thereof in a direction essentially corresponding to that of the longitudinal axis of the cylindrical portion, wherein the engaging protrusion has easily breakable lines for rendering the engaging protrusion deformable.

* * * * *